US006593905B1

(12) United States Patent
Lay

(10) Patent No.: US 6,593,905 B1
(45) Date of Patent: Jul. 15, 2003

(54) LIQUID CRYSTAL DISPLAY PANEL AND THE CONTROL METHOD THEREOF

(75) Inventor: Chung-Wen Lay, Taipei Hsien (TW)

(73) Assignee: AU Optronics Corp., Hsinchu (TW)

( * ) Notice: Subject to any disclaimer, the term of this patent is extended or adjusted under 35 U.S.C. 154(b) by 173 days.

(21) Appl. No.: 09/724,245

(22) Filed: Nov. 27, 2000

(30) Foreign Application Priority Data

Aug. 8, 2000 (TW) ..... 89115919 A

(51) Int. Cl.[7] ..... G09G 3/36; G09G 5/00

(52) U.S. Cl. ..... 345/92; 345/92; 345/98; 345/100; 345/204; 345/211

(58) Field of Search ..... 345/58, 92, 98, 345/100, 204, 211, 94, 87, 90

(56) References Cited

U.S. PATENT DOCUMENTS 5,313,222 A * 5/1994 Lee ..... 345/100
5,510,805 A * 4/1996 Lee ..... 345/100
5,528,256 A * 6/1996 Erhart et al. ..... 345/211
5,648,790 A * 7/1997 Lee ..... 345/100
6,064,363 A 5/2000 Kwon ..... 345/98
6,124,840 A * 9/2000 Kwon ..... 345/100
6,323,851 B1 * 11/2001 Nakanishi ..... 345/204

* cited by examiner

*Primary Examiner*—Bipin Shalwala
*Assistant Examiner*—Prabodh Dharia
(74) *Attorney, Agent, or Firm*—Ladas & Parry

(57) ABSTRACT

A liquid crystal display panel, which is driven by the dot-inversion driving scheme or the column-inversion driving scheme, and its control method. There is a recycling transistor located between two display cells in the same scan line, where the gate is connected to a previous scan line and the source/drain are connected between display electrodes of these two display cells. When the previous scan line is scanned, the recycling transistor is turned on and the coupled charges on these two display electrodes are re-distributed. Since the polarity of the original video signals are different, the voltages of the display electrodes are close to the common electrode voltage after the recycling process. Accordingly, when the scan line is scanned, the voltages of the display electrodes are only required to be pulled up or pulled down from the common electrode voltage.

5 Claims, 8 Drawing Sheets

ODD

| | Dn-1 | Dn | Dn+1 |
|---|---|---|---|
| Gm-1 | + | + | + |
| Gm | + | + | + |
| Gm+1 | + | + | + |

EVEN

| | Dn-1 | Dn | Dn+1 |
|---|---|---|---|
| Gm-1 | − | − | − |
| Gm | − | − | − |
| Gm+1 | − | − | − |

ODD

| | Dn-1 | Dn | Dn+1 |
|---|---|---|---|
| Gm-1 | + | + | + |
| Gm | − | − | − |
| Gm+1 | + | + | + |

EVEN

| | Dn-1 | Dn | Dn+1 |
|---|---|---|---|
| Gm-1 | − | − | − |
| Gm | + | + | + |
| Gm+1 | − | − | − |

FIG. 3B (PRIOR ART)

ODD

| | Dn-1 | Dn | Dn+1 |
|---|---|---|---|
| Gm-1 | + | − | + |
| Gm | + | − | + |
| Gm+1 | + | − | + |

EVEN

| | Dn-1 | Dn | Dn+1 |
|---|---|---|---|
| Gm-1 | − | + | − |
| Gm | − | + | − |
| Gm+1 | − | + | − |

FIG. 3C (PRIOR ART)

ODD

| | Dn-1 | Dn | Dn+1 |
|---|---|---|---|
| Gm-1 | + | − | + |
| Gm | − | + | − |
| Gm+1 | + | − | + |

EVEN

| | Dn-1 | Dn | Dn+1 |
|---|---|---|---|
| Gm-1 | − | + | − |
| Gm | + | − | + |
| Gm+1 | − | + | − |

FIG. 3D (PRIOR ART)

LIQUID CRYSTAL DISPLAY PANEL AND THE CONTROL METHOD THEREOF

BACKGROUND OF THE INVENTION

1. Field of the Invention

The present invention relates to a method of controlling a liquid crystal display panel (LCD panel), and more particularly to a driving method and a circuit for recycling charges on display electrodes using adjacent scan line control signals, thereby reducing the power consumption and lowering the time required for charging and discharging of the display electrode.

2. Description of the Related Art

FIG. 1 (PRIOR ART) schematically shows an equivalent circuit of the conventional thin film transistor liquid display panel (hereafter referred to as TFT-LCD). As shown in the figure, the liquid crystal display panel is composed of the cross-connected data electrodes (D1, D2, D3, . . . and Dy) and the scan electrodes (G1, G2, . . . and Gx), each pair of the data electrodes and the scan electrodes can be used to control a display cell. For example, data electrode D1 and scan electrode G1 can be used to control the display cell 100. As shown in the figure, the equivalent circuit of display cell 100 (the same for other display cells) include a thin film transistor 10 for controlling, a storage capacitor Cs and a liquid crystal capacitor Clc constructed by the display electrode and the common electrode. The gate and the drain of the thin film transistor 10 are connected to scan electrode G1 and data electrode D1 respectively. The video signal carried by the data electrode D1 can be written to the display cell 100 by controlling the conducting state of the thin film transistor 10 using the scan signal carried by the scan electrode G1.

Scan driver 3 sends out the scan signal on the scan electrode G1, G2, . . . Gx sequentially, according to scan control signals. When one of the scan electrode is scanned, the thin film transistors corresponding to this scanned scan electrode are turned on and the thin film transistors corresponding to other scan electrodes are turned off. When the thin film transistors of the display cells on a row are turned on, data driver 2 sends corresponding video signal (gray level) to y display cells on the row through data electrode D1, D2, and Dy according to the image data to be displayed. When scan driver 3 finishes the scanning of the x scan lines, the display of a single video frame is done. The scanning of the scan lines described above is performed repeatedly, thereby displaying subsequent video frames.

According to the relationship between the common electrode voltage VCOM and the sent video signals on the data electrode, the polarities of the sent video signals on the data electrodes can be positive or negative relative to the common electrode voltage VCOM. FIG. 2 (PRIOR ART) schematically shows the relationship between the common electrode voltage VCOM and the video signals of different polarities. As shown in FIG. 2, the positive video signals are positioned between common electrode voltage VCOM and the system high voltage VDD. According to the gray level represented by the positive video signal, the actual voltage is positioned between voltages Vp1 and Vp2 (in general, the closer the positive video signal to the common electrode voltage, the lower its gray level). In contrast, the negative video signals are positioned between common electrode voltage VCOM and the system low voltage VSS. According to the gray level represented by the negative video signal, the actual voltage is positioned between voltage Vn1 and Vn2 (Similarly, the closer the negative video signal to the common electrode voltage, the lower the gray level it corresponds to). When the positive video signal and the negative video signal corresponding to the same gray level have the same visual effect theoretically.

To prevent the liquid crystal molecules being subjected to a voltage bias of single polarity and therefore shortening the life of the liquid crystal molecules, a single display cell in the general TFT-LCD is driven by video signals of opposite polarities in the odd-numbered video frames and even-numbered video frames.

There are four driving schemes to achieve the above-described requirement, including frame-inversion, line-inversion, column-inversion and dot-inversion.

FIG. 3A (PRIOR ART) shows the pattern of the polarities of the video signals received by the display cells in the frame-inversion driving scheme. As shown in FIG. 3A, two diagrams show the patterns of the polarities of the video signals received by each display cell in the area defined by data electrodes Dn−1, Dn, Dn+1 and scan electrodes Gm−1, Gm, Gm+1 in an odd-numbered video frame and an even-numbered video frame, respectively. In the left diagram, which-is corresponding to the odd-number video frame, all video signals are positive (denoted by "+"). On the other hand, in the right diagram corresponding to the even-numbered video frame, all video signals are negative (denoted by "−"). The frame-inversion driving scheme uses video signals of different polarities in adjacent video frames for all display cells.

FIG. 3B (PRIOR ART) shows the pattern of the polarities of the video signals in the line-inversion driving scheme. The difference between FIG. 3A and FIG. 3B lies in that the display cells of the same row (the same data line) in the same video frame receive video signals of the same polarity, however the display cells of the adjacent rows receive video signals of the opposite polarity.

FIG. 3C (PRIOR ART) shows the pattern of the polarities of the video signals in the column-inversion driving scheme. The arrangement of the video signal polarities in FIG. 3C is similar to that in FIG. 3B. The display cells of the same columns (the same data lines) in the same video frame receive the video signals of the same polarity, and the display cells of the adjacent columns receive video signals of the opposite polarity.

FIG. 3D (PRIOR ART) shows the pattern of the polarities of the video signals in the dot-inversion driving scheme. In the dot-inversion driving scheme, if one display cell is driven by the positive video signal, the four display cells adjacent to this display cell are driven by the negative video signals.

FIG. 4 (PRIOR ART) shows a circuit diagram of a portion of the conventional liquid crystal display panel, including data electrodes (Dn−1, Dn and Dn+1), scan electrodes (Gm−1, Gm) and the corresponding display cells. When the scan signal appears on the scan electrode Gm−1, the thin film transistors connected to scan electrode Gm−1 are turned on and the video signals on data electrodes Dn and Dn+1 can be coupled to the display electrodes of the corresponding display cells. When the scan signal appears on scan electrode Gm, thin film transistors TFT1 and TFT2 connected to scan electrode Gm are turned on and the video signals on data electrodes Dn and Dn+1 can be coupled to the display electrodes P1 and P2 of the corresponding display cells.

Assume that the circuit shown in FIG. 4 adopts the dot-inversion or column-inversion driving scheme for determining the polarities of various video signals. FIG. 5

(PRIOR ART) shows a timing diagram of the signals in display electrodes P1 and P2 and scan electrodes Gm−1 and Gm. Pulses 20 and 21 in the scan electrode Gm−1 indicate the scanning of the scanning line corresponding to scan electrode Gm−1 in two adjacent video frames, respectively. Pulses 30 and 31 in the scan electrode Gm indicate the scanning of the scanning line corresponding to scan electrode Gm in the corresponding video frames, respectively. Each scan signals 20, 21, 30 and 31 can turn on the connected thin film transistors, thereby coupling the video signals on the data electrodes to the corresponding display electrodes.

The operation is described as follows by using scan electrode Gm as an example. Before the scan signal 30 is sent (before time t1), the video signal coupled to the display electrode P1 is positive (between voltages Vp1 and Vp2), and the video signal coupled to the display electrode P2 is negative (between voltages Vn1 and Vn2).

During the period of the scan signal 30 (t1~t2), the scan signal 30 turns on thin film transistors TFT1 and TFT2, and video signals couple to display electrode P1 and P2 through data electrodes Dn and Dn+1. As mentioned above, the video signal coupled to one display cell in one video frame has a polarity opposite to that of the video signal coupled to the same display cell in the previous video frame.

Therefore, during the period t2~t3, the thin film transistors TFT1 and TFT2 are turned off. The video signal coupled to the display electrode P1 is negative in polarity (between voltages Vn1 and Vn2), and the video signal coupled to the display electrode P2 is positive (between voltages Vp1 and Vp2).

After completing the scanning of other scan lines (Gm+1~Gx, G1~Gm−1), the scan signal 31 corresponding to next video frame is sent to the scan electrode Gm (time t3–t4). At this time, the polarity of the video signal is opposite to that in the previous video frame. In other words, the video signal coupled to display electrode P1 is positive (between voltages Vp1 and Vp2), and the video signal coupled to display electrode P2 is negative (between voltages Vn1 and Vn2). Therefore, the video signals of opposite polarities are sequentially sent to the corresponding display cells in adjacent odd-numbered video frames and even-numbered video frames.

However, there is a drawback in the conventional driving schemes. More specifically, since the video signals sent out by data electrodes change either from the positive polarity to the negative polarity or from the negative polarity to the positive polarity, the driving schemes require a lot of power and too much heat is generated.

U.S. Pat. No. 6,064,363 disclosed a technique of recycling charges to reduce the violent variation of voltage levels in these video signals. A recycling cell is designed for adjacent two data electrodes. The recycling cell is controlled by control signals generated by additionally control circuitry. It can recycle the charges on the adjacent data electrodes before one of the scan lines is scanned (i.e. for all of the display cells in the same scan line), and evenly distributes them. Since the adjacent display cells receive video signals of different polarities in the dot-inversion driving scheme, the voltage on the data electrodes can approach to the common electrode voltage VCOM after the charges are recycling and evenly distributed. Driving these data electrodes only requires driving to a level corresponding to the positive or negative polarity from the common electrode voltage VCOM, thereby reducing power consumption.

However, the '363 patent also has its disadvantages. First, the '363 patent employs the independent control signal to control the above-mentioned charge-recycling mechanism, and, therefore, an extra control circuit is required to generate the corresponding control signal. Furthermore, in the '363 patent, the charges on the adjacent data electrodes are recycled and re-distributed for every scanning line. In addition, since the thin film transistors of the display cells are turned off during the charge-recycling stage, the charges on the display electrodes are not recycled and the charges induced in the last video frame still remain in the display electrodes. In fact, when the data driver couples the video signals to the corresponding display cells, it should drive data electrodes as well as the display electrodes inside the display cells. Hence, the data driver still drives the display electrodes between positive video signal levels and negative video signal in a very short period. Obviously, the power-consumption problem cannot be completely solved by the mechanism proposed by the '363 patent.

SUMMARY OF THE INVENTION

An object of the present invention is to provide a novel liquid crystal display panel and the control method thereof, which do not need extra control circuitry to perform the charge recycling and redistribution process for charges resided in the data electrodes and coupled within the display electrodes. Therefore, the power consumption is reduced.

The liquid crystal display panel of the present invention is controlled and driven by data drivers and scanning drivers. The video signals from the data drivers are in the dot-inversion or column-inversion driving scheme. In other words, the video signals from two adjacent data lines are of opposite polarities. The liquid crystal display panel includes a first data electrode and a second data electrode to receive video signals of different polarities. The first data electrode and the second data electrode, together with a scan electrode crossing them, correspond to a first display cell and a second display cell, respectively. Every display cell has its own display electrode and the control transistor. In addition, the gate of the control transistor is coupled to the scan electrode, and the source and the drain of the control transistor are coupled between the display electrode and the corresponding data electrode. The video signal on the data electrode is coupled to the internal display electrode under the control of the scanning signal on the scan electrode. There is a recycling transistor located between the first display cell and the second display cell. The gate of the recycling transistor is coupled to another scanning electrode which is preferably adjacent to the present scan electrode and scanned earlier than the present scan electrode. The source and the drain of this recycling transistor are coupled between the display electrodes of the first display cell and the second display cell. In other words, when the adjacent scan electrode is scanned previously, the recycling transistor can be turned on to redistribute the charges in the display electrodes of the first display cell and the second display cell.

Since the polarities of the original video signals are opposite, the resulted voltage on the display electrodes of the first display cell and the second display cell is very close to the common electrode voltage (VCOM) after recycling and redistributing. Therefore, the power consumption is reduced. In fact, the display electrode of each display cell can be coupled to the display electrodes of adjacent display cells on the same scan line by means of two recycling transistors.

In addition, the present invention also provides a method of controlling a liquid crystal display panel. The scanning driver sends scanning signals to the individual scanning electrodes sequentially to turn on the control transistors of all the display cells on the corresponding scanning electrodes. Meanwhile, the data driver sends the corresponding video signals to the data electrodes. These video signals are coupled to the display electrodes of the display cells through the turned-on control transistors. In addition, these scanning signals can be used to control an device, which can be used to conduct display electrodes of adjacent display cells on a scanning electrode different from the present scanning electrode. Therefore, charges on the display electrodes and data electrodes can be evenly redistributed and the power for driving the video signals to the display electrodes can be reduced. The control method includes the following two steps. A first scanning signal is transmitted to a scanning electrode (Gm−1) that is scanned earlier than the target scanning electrode (Gm) in the same video frame. This first scanning signal can turn on the recycling switch to redistribute the charges on the first display electrode and the second display electrode. The voltage level of the first display electrode or the second display electrode is very close to the common electrode voltage VCOM. When the scanning electrode (Gm) is scanned, the data driver can drive these display cells from the common electrode voltage VCOM to the corresponding video signal levels.

BRIEF DESCRIPTION OF THE DRAWINGS

The present invention can be more fully understood by reading the subsequent detailed description in conjunction with the examples and references made to the accompanying drawings, wherein:

FIG. 2 (PRIOR ART) schematically shows the relationship between the common electrode voltage VCOM and the video signals of different polarities;

FIGS. 3A–3D (PRIOR ART) show the patterns of the polarities of the video signals in the frame-inversion driving scheme, the line-inversion driving scheme, the column-inversion driving scheme and the dot-inversion driving scheme;

DETAILED DESCRIPTION OF THE PREFERRED EMBODIMENT

The liquid crystal display panel of the present invention uses the existing scanning signals to activate the process of recycling and redistributing charges on the data electrodes as well as the display electrodes in the display cells, thereby reducing the actual power required to couple video signals.

First Embodiment

Figure 1:
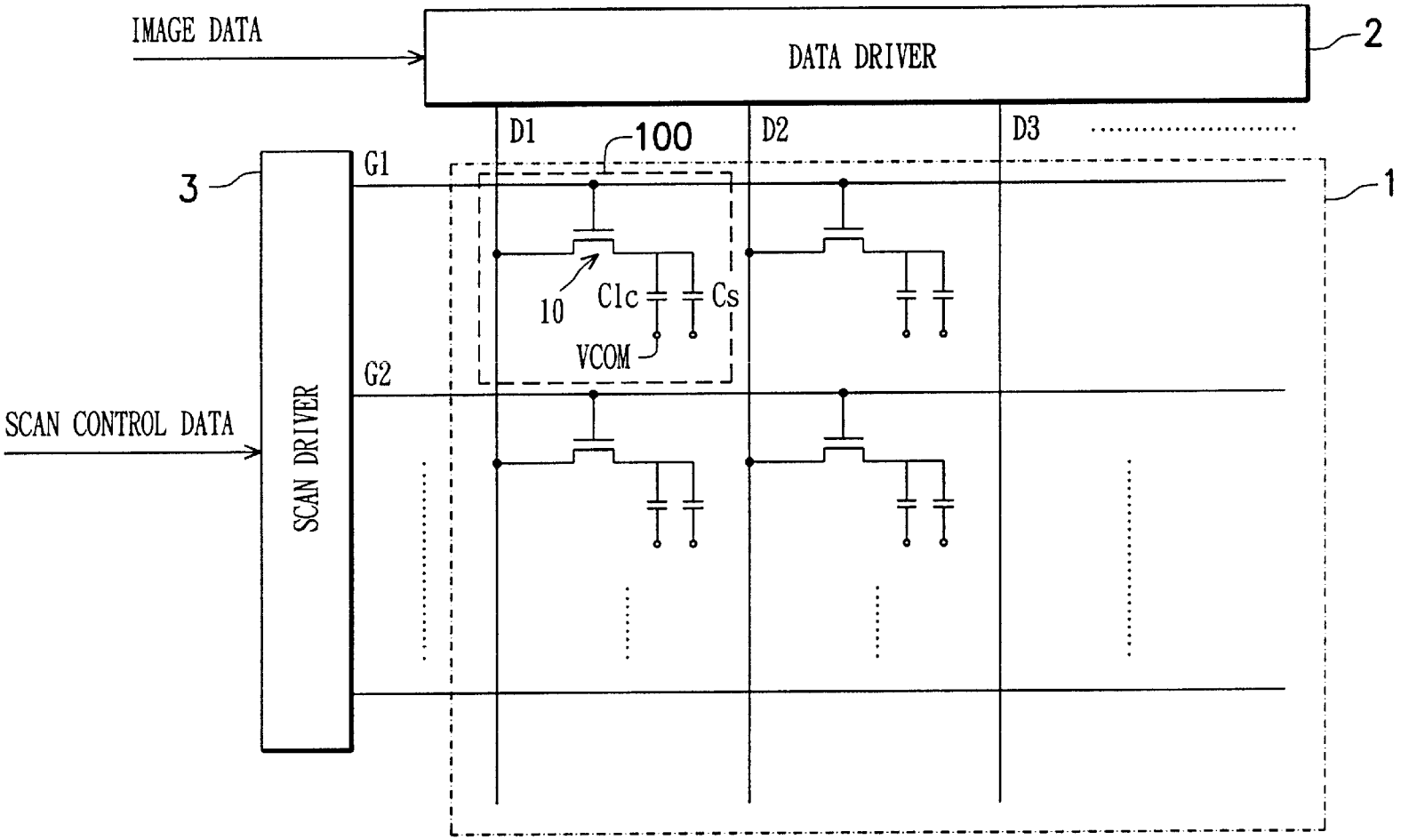
FIG. 1 (PRIOR ART)
FIG. 1 (PRIOR ART) shows a schematic diagram of an equivalent circuit of the conventional thin-film transistor liquid crystal display device.
Figures 2, 3A:
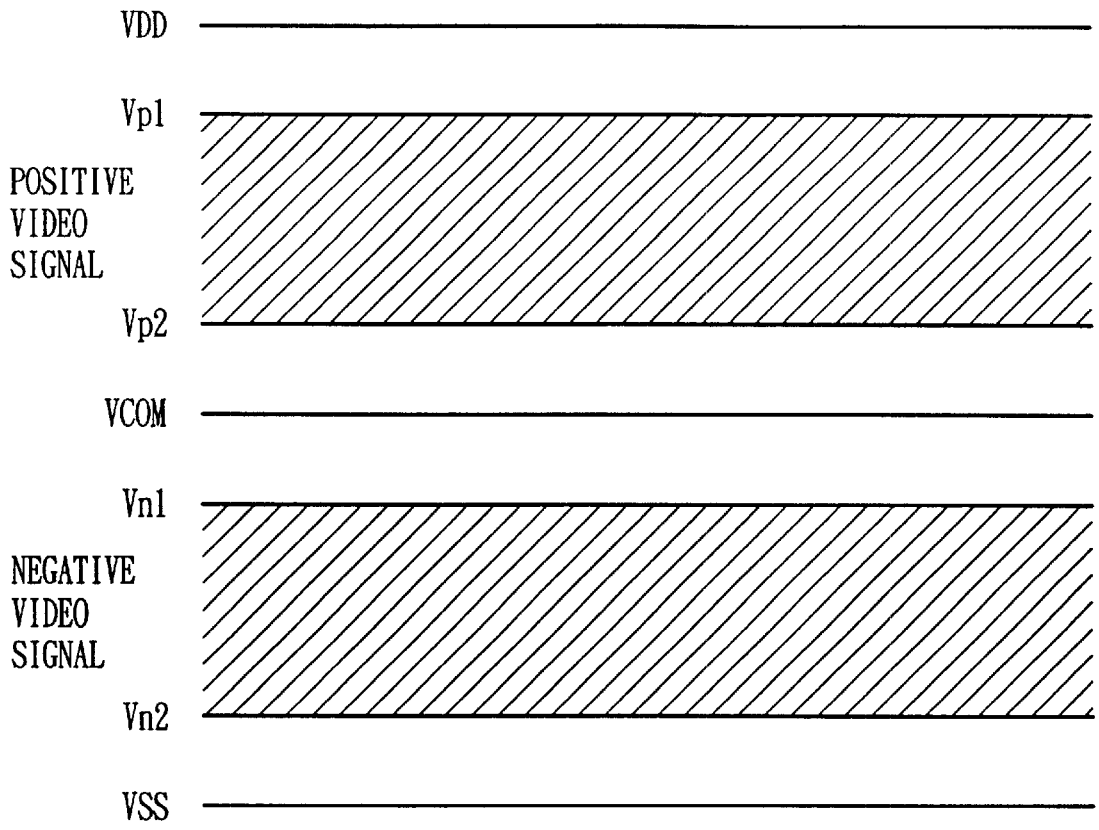
FIG. 2 (PRIOR ART)
FIG. 3A (PRIOR ART)
Figure 4:
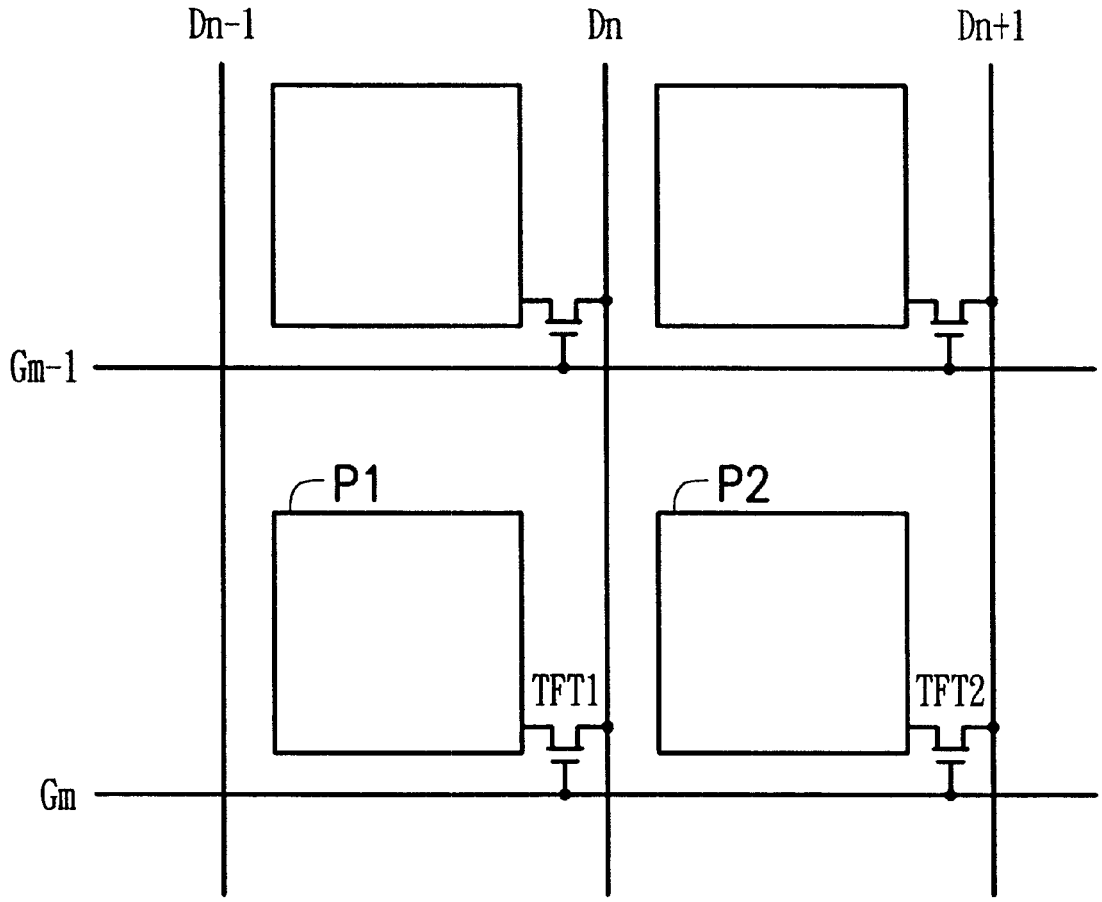
FIG. 4 (PRIOR ART)
FIG. 4 (PRIOR ART) schematically shows an equivalent circuit diagram of the conventional liquid crystal display panel.
Figure 5:
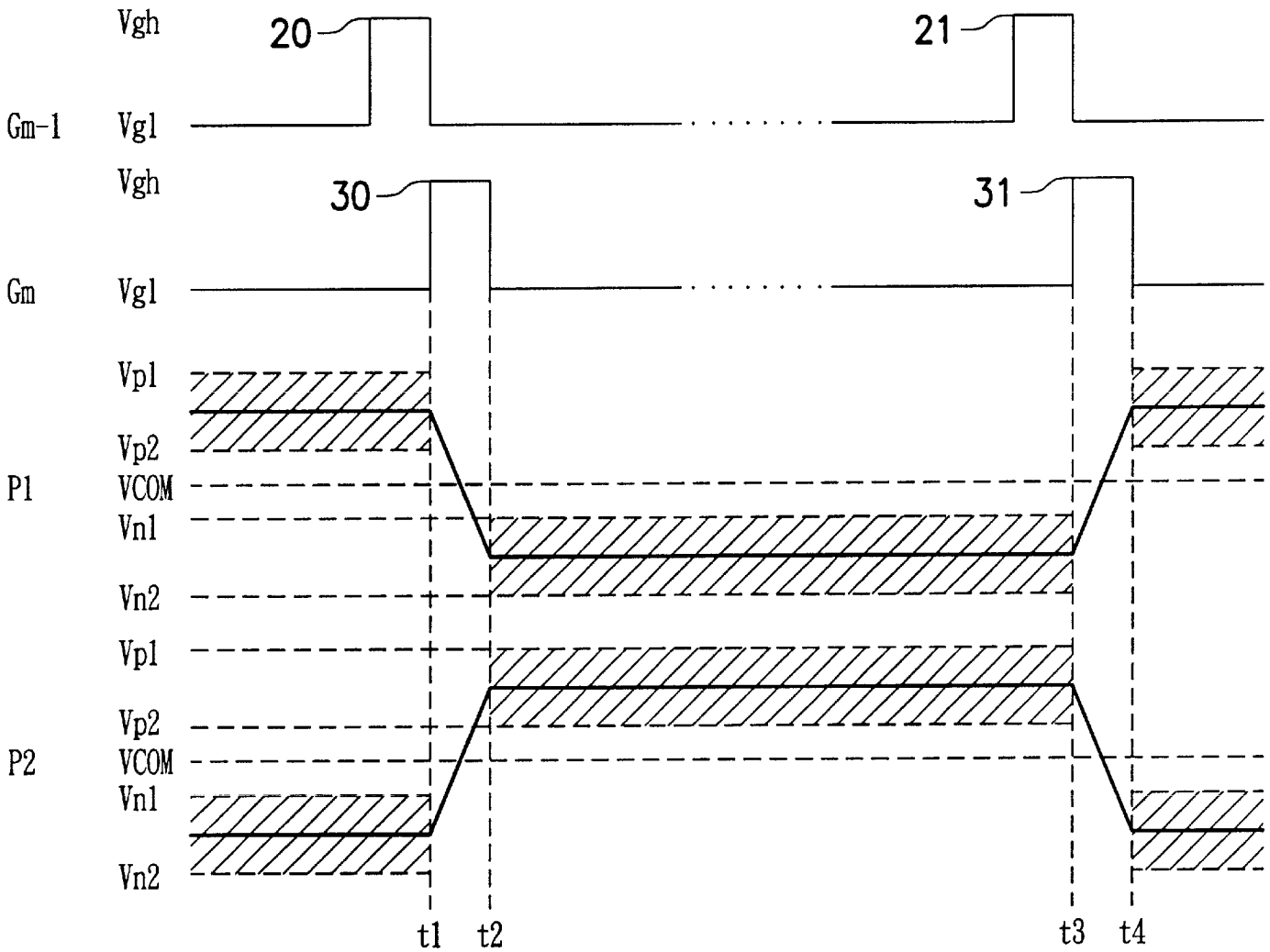
FIG. 5 (PRIOR ART)
FIG. 5 (PRIOR ART) shows a timing diagram of the signals in display electrodes P1 and P2 and scan electrodes Gm−1 and Gm in FIG. 4.
Figure 6:
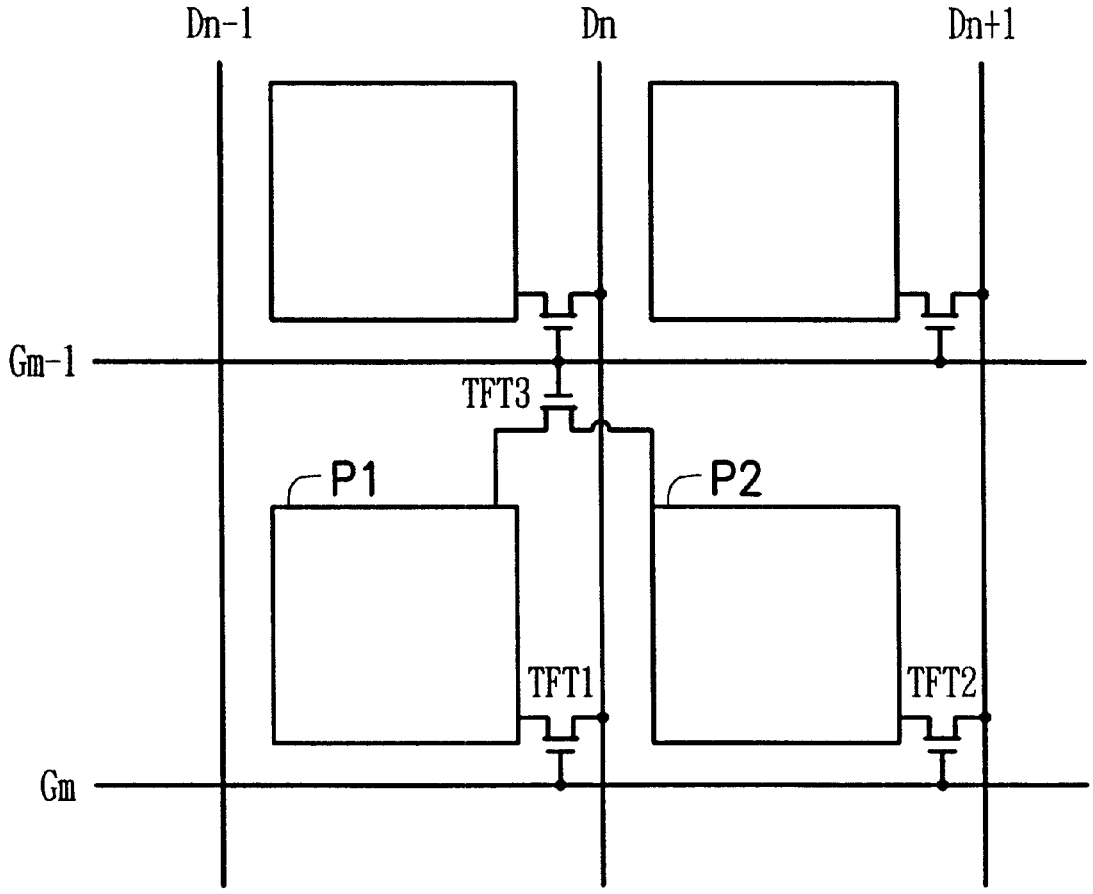
FIG. 6 shows a schematic diagram of the circuit of the liquid crystal display panel in accordance with the first embodiment of the present invention.

FIG. 6 shows a schematic diagram of the circuit of the liquid crystal display panel in accordance with the first embodiment of the present invention. As shown in the figure, the circuit shown in FIG. 6 is quite similar to that of FIG. 4. The circuit shown in FIG. 6 includes vertical data electrodes Dn−1, Dn, Dn+1 and horizontal scanning electrodes Gm−1 and Gm. Every pair of the data electrodes (Dn, Dn+1) and the scanning electrodes (Gm−1, Gm) are used to control a display electrode in a display cell. The following discussion only focuses on the adjacent two display cells, including the corresponding thin film transistors TFT1, TFT2 and the display electrodes P1 and P2, respectively, on the scanning electrode Gm. Other devices, such as storage capacitors and common electrodes, are not shown in FIG. 6 for the sake of clarity.

In the liquid crystal display panel shown in FIG. 6, there is a recycling transistor TFT3 located between these two adjacent display cells. The gate of the recycling transistor TFT3 is coupled to a previous scanning electrode Gm−1, and the source and the drain of the recycling transistor TFT3 are coupled to the display electrodes P1 and P2. The status of the recycling transistor TFT3 is determined by the scanning signal carried by the scanning electrode Gm−1. In other words, when the scan line corresponding to the scanning electrode Gm−1 is scanned (i.e. the scanning pulse is present), the transistor TFT3 is turned on and a coupling path is established between the display electrodes P1 and P2. Since the display electrodes P1 and P2 previously receive video signals of opposite polarities in the column-inversion or dot-inversion driving scheme, the charges on the display electrodes P1, P2 are recycled and redistributed and the voltages of the display electrodes P1 and P2 are close to common electrode voltage VCOM. Therefore, when the scan line corresponding to the scanning electrode Gm is scanned, the driver only need to drive display electrodes P1, P2 from the common electrode voltage VCOM to positive/negative video signal level. Accordingly, the power consumption can be reduced.

Figure 7:
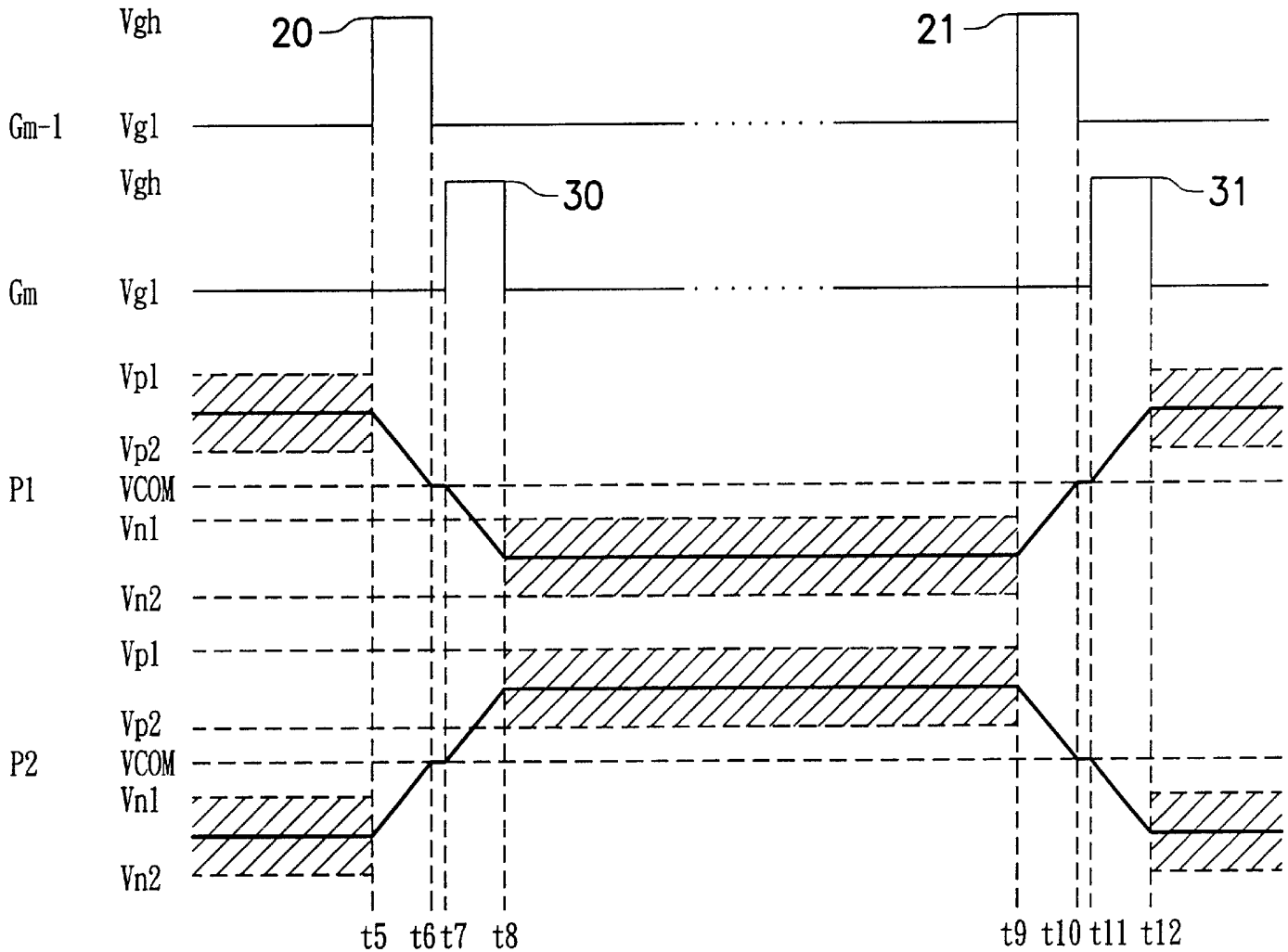
FIG. 7 shows a timing diagram of the signals in the scanning electrodes Gm−1, Gm and the display electrodes P1, P2 in FIG. 6.

FIG. 7 shows a timing diagram of the signals on the scanning electrodes Gm−1 and Gm and the display electrodes P1, P2 in FIG. 6. In FIG. 7, the pulses 20 and 21 on the scanning electrode Gm−1 represent scanning duration of the scan line corresponding to the scanning electrode Gm−1 in two video frames (denoted by n and n+1), respectively. The pulses 30 and 31 on the scanning electrode Gm represent scanning duration of the scan line corresponding to the scanning electrode Gm in the video frame n and video frame n+1.

Each scanning pulses (20, 21, 30, 31) can turn on the thin-film transistors connected to the corresponding scanning electrodes, so that video signals on the data electrodes can be coupled to the corresponding display electrodes.

As shown in FIG. 7, before the duration of the scanning line m−1 of the video frame n (before time t5), the video signal stored in the capacitor of the display electrode P1 is positive (between voltages Vp1 and Vp2) and the video signal stored in the capacitor of the display electrode P2 is negative (between voltages Vn1 and Vn2).

During the duration of the scanning line m−1 of the video frame n, the scanning electrode Gm−1 transmits a scanning pulse 20 and starts the scanning operation (from t5 to t6). This scanning pulse 20 can turn on the recycling transistor TFT3. When the recycling transistor TFT3 is turned on, a coupling path between the display electrodes P1 and P2 in the display cells is established. Accordingly, charges on the display electrodes P1 and P2 can be evenly distributed over both of them. Generally speaking, the resulted voltages on the display electrodes P1 and P2 approach to the common electrode voltage VCOM due to their original opposite polarities.

Next, when the scanning electrode Gm transmits scanning pulse 30 to scan the scanning line n (from t7 to t8), the thin film transistors TFT1 and TFT2 are turned on and video signals on data electrodes Dn and Dn+1 are coupled to the display electrode P1 and P2. At this time, the video signal of the data electrode Dn is negative and the video signal of the data electrode Dn−1 is positive.

Since the voltages on the display electrodes P1 and P2 are close to the common electrode voltage VCOM in the previous scanning operation, the driver only needs to pull up from the common electrode voltage VCOM to a positive video signal level or pull down to a negative video signal level. As shown in the diagram, the display electrode P1 is pulled down to be negative (between voltages Vn1 and Vn2) and the display electrode P2 is pulled up to be positive (between voltages Vp1 and Vp2).

When the scan line corresponding to the scan electrode Gm−1 is scanned in the next video frame n+1, the scan pulse 21 is transmitted (t9~t10). As a result, the recycling transistor TFT3 is turned on and the charges on the display electrodes P1 and P2 are evenly distributed. Accordingly the voltages on the display electrodes P1 and P2 approach to the common electrode voltage VCOM. Next, when the scanning pulse 31 is transmitted on the scanning electrode Gm (t11~t12), video signals are coupled to the display electrodes P1 and P2 through the data electrodes Dn and Dn+1. At this time, the video signal of the data electrode Dn is positive and the video signal of the data electrode Dn−1 is negative. Hence, the voltages of the display electrodes P1 and P2 are pulled up or pulled down from the common electrode voltage VCOM. The subsequent scanning operation repeats the above procedures.

As mentioned above, the redistribution of the recycled charges used in this embodiment is activated by means of the scanning pulses on the previous scan line, thereby recycling the charges on the display electrodes of display cells. It is noted that that the conducting status of the recycling transistor TFT3 is controlled by the scanning pulse on the previous adjacent scan line (the scanning electrode Gm−1) is not a limitation of the present invention. It is understood by those skilled in the art that the recycling process of the present scan line (Gm) can be controlled by any previous-scanned scan lines (for example, Gm−2 or Gm−3 and so on). However, it is also noted that the recycling process should not be far from the scanning operation for one scan line, thereby preventing from the reduction of the picture quality. In addition, the recycling transistor TFT3 can be located between two of the display cells of the same scan line that receive video signals of different polarities in the same video frame.

Second Embodiment

Figure 8:
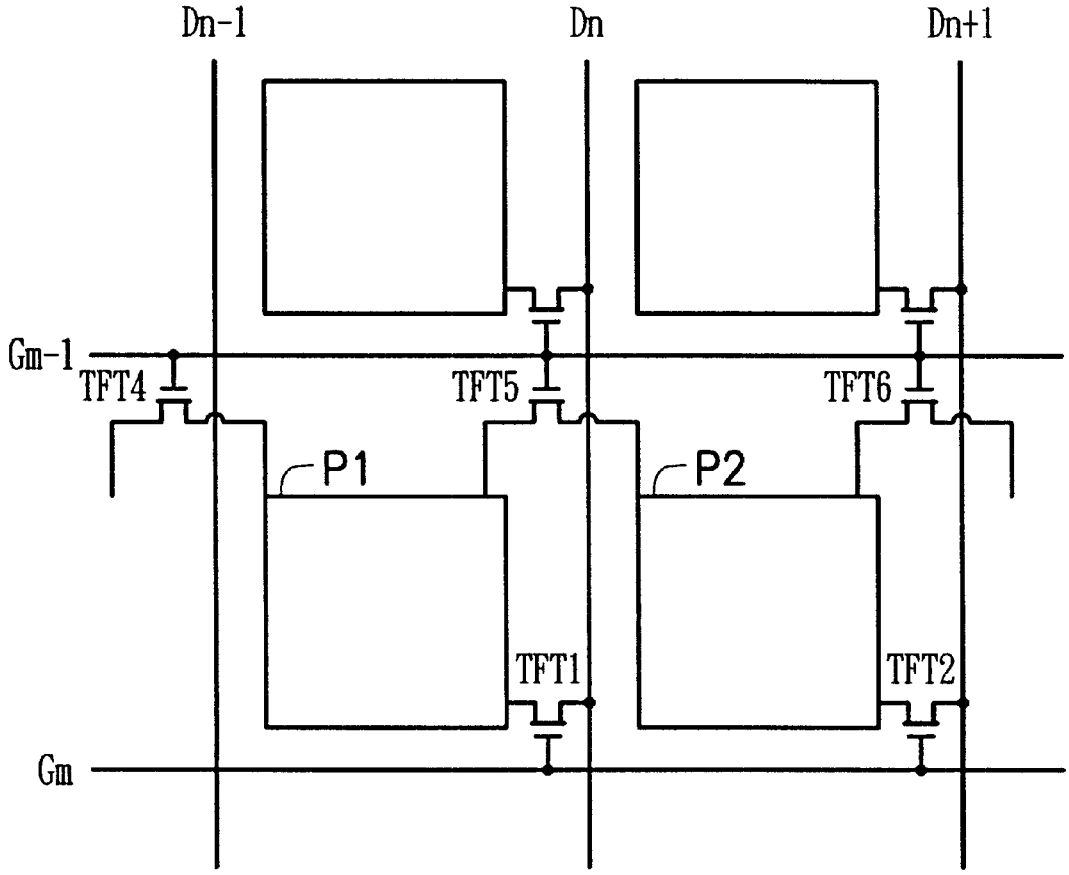
FIG. 8 shows a schematic diagram of the circuit of the liquid crystal display panel in accordance with the second embodiment of the present invention.

In the first embodiment, the recycling transistor is located between every two adjacent display cells on the same scan line. In this embodiment, the recycling transistors are located between all display cells of the same scan line. FIG. 8 shows a schematic diagram of the circuit of the liquid crystal display panel in accordance with this embodiment. As shown in the figure, the display electrode P1 is connected to the recycling transistors TFT4 and TFT5, where the recycling transistor TFT4 is used to couple to a display electrode of a display cell (not shown) on the left side of the transistor TFT4 and the recycling transistor TFT5 is used to couple to the display electrode P2 of the display cell on the right side of the transistor TFT5. Furthermore, the display electrode P2 is connected to the recycling transistors TFT5 and TFT6, where the recycling transistor TFT5 is used to couple to the display electrode P1 of the display cell on the left side of the transistor TFT5 and the recycling transistor TFT6 is used to a display electrode of a display cell (not shown) on the right side of the transistor TFT6. Gates of the recycling transistors TFT4, TFT5, TFT6 are all connected to the scanning electrode Gm−1.

The operation is similar to that of the first embodiment. When the scan line corresponding to the scanning electrode Gm−1 is scanned, the recycling transistors TFT4, TFT5 and TFT6 are turned on, and, therefore, a common coupling path between all display electrodes on the scanning electrode Gm is established. This coupling path allows the charges on these display cells to be recycled. and redistributed. After these charges are redistributed, the voltages on all display electrodes are quite close to the common electrode voltage VCOM. Therefore, when the scanning electrode Gm is scanned, these display electrodes need only be pulled up to be positive (between Vp1 and Vp2) or pulled down to be negative (between Vn1 and Vn2) from the common electrode voltage VCOM, thereby reducing power consumption.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A liquid crystal display panel, comprising:

a first data electrode;

a second data electrode;

a first scanning electrode;

a second scanning electrode adjacent to the first scanning electrode, being scanned earlier than the first scanning electrode in the same video frame;

a first display cell having a first display electrode and a first control transistor, a first gate of the first control transistor coupled to the first scanning electrode, and a first source and a first drain of the first control transistor coupled to the first display electrode and the first data electrode, respectively;

a second display cell having a second display electrode and a second control transistor, a second gate of the second control transistor being coupled to the first scanning electrode, and a second source and a second drain of the second control transistor coupled to the second display electrode and the second data electrode, respectively; and a first recycling transistor, a third gate thereof coupled to the second scanning electrode, and a third source and a third drain thereof coupled to the first display electrode and the second display electrode, respectively.

2. The liquid crystal display panel as claimed in claim 1, further comprising:

a third data electrode located on the opposite side of the second data electrode from the first data electrode;

a third display cell having a third display electrode and a third control transistor, a fourth gate of the third control transistor coupled to the first scanning electrode, and a fourth source and a fourth drain of the third control transistor coupled to the third display electrode and the third data electrode respectively; and a second recycling transistor, a fifth gate thereof coupled to the second scanning electrode, a fifth source and a fifth drain thereof coupled to the third display electrode and the second display electrode, respectively.

3. A method of controlling a liquid crystal display panel having a first data electrode, a second data electrode, a first scanning electrode, a second scanning electrode, a first recycling transistor, a first display cell having a first display electrode and a first control transistor, and a second display cell having a second display electrode and a second control transistor; wherein a first gate of the first control transistor is coupled to the first scanning electrode, and a first drain and a first source of the first control transistor are respectively coupled to the first display electrode and the first data electrode, and wherein a second gate of the second control transistor is coupled to the first scanning electrode, and a second drain and a second source are respectively coupled to the second display electrode and the second data electrode, and a third gate of the first recycling switch is coupled to the second scanning electrode, and a third drain and a third source of the first recycling transistor are respectively coupled to the first display electrode and the second display electrode, the method comprising the steps of:

transmitting the second scanning signal to the second scanning electrode to turn on the first recycling transistor to redistribute the charges on the first display electrode and the second display electrode; and transmitting the first scanning signal to the first scanning electrode to turn on the first control transistor and the second control transistor so that a first video signal carried on the first data electrode and a second video signal carried on the second data electrode are respectively sent to the first display electrode and the second display electrode, wherein the first video signal carried on the first data electrode has a positive polarity and the second video signal carried on the second data electrode has a negative polarity.

4. A liquid crystal display device, comprising:

a data driver for generating a first video signal and a second video signal having opposite polarities in a video frame;

a scanning driver for generating a first scanning signal and a second scanning signal; and a liquid crystal display panel coupled to the data driver and the scanning driver, having:

a first data electrode for receiving the first video signal;

a second data electrode for receiving the second video signal;

a first scanning electrode for receiving the first scanning signal;

a second scanning electrode for receiving the second scanning signal, wherein the second scanning electrode is adjacent to the first scanning electrode and is scanned earlier than the first scanning signal in the same video frame;

a first display cell having a first display electrode and a first control transistor, a first gate of the first control transistor coupled to the first scanning electrode, a first source and a first drain of the first control transistor coupled to the first display electrode and the first data electrode respectively, for coupling the first video signal to the first display electrode; a second display cell having a second display electrode and a second control transistor, a second gate of the second control transistor coupled to the first scanning electrode, a second source and a second drain of the second control transistor coupled to the second display electrode and the second data electrode respectively, for coupling the second video signal to the second display electrode; and a first recycling transistor, a third gate thereof coupled to the second scanning electrode for receiving the second scanning signal, and a third source and a third drain of the first recycling transistor coupled to the first display electrode and the second display electrode respectively, for redistributing charges on the first display electrode and the second display electrode.

5. The liquid crystal display device as claimed in claim 4, wherein the data driver generates a third video signal and the liquid crystal display panel further comprises:

a third data electrode for receiving the third video signal, on the opposite side of the second data electrode from the first data electrode;

a third display cell having a third display electrode and a third control transistor, a fourth gate of the third control transistor coupled to the first scanning electrode, and a fourth source and a fourth drain of the third control transistor being coupled to the third display electrode and the third data electrode for coupling the third video signal to the third display electrode; and a second recycling transistor, a fifth gate thereof coupled to the second scanning electrode, a fifth source and a fifth drain thereof coupled to the third display electrode and the second display electrode, the first recycling transistor and the second recycling transistor redistributing charges on the first display electrode, the second display electrode and the third display electrode.

* * * * *